US006986677B2

(12) United States Patent
Janssen

(10) Patent No.: US 6,986,677 B2
(45) Date of Patent: Jan. 17, 2006

(54) SEAL CARRYING ELECTRICAL CONTACT

(75) Inventor: Johannes Martinus Paulus Janssen, Beek en Donk (NL)

(73) Assignee: Tyco Electronics Nederland B.V., AG's-Hertogenbosch (NL)

( * ) Notice: Subject to any disclaimer, the term of this patent is extended or adjusted under 35 U.S.C. 154(b) by 0 days.

(21) Appl. No.: 10/871,750

(22) Filed: Jun. 18, 2004

(65) Prior Publication Data

US 2005/0026488 A1 Feb. 3, 2005

(30) Foreign Application Priority Data

Jun. 25, 2003 (EP) ..... 03014296

(51) Int. Cl.
*H01R 13/52* (2006.01)

(52) U.S. Cl. ..... 439/275

(58) Field of Classification Search ..... 439/587, 439/489, 589, 647, 784, 271–283, 588; 174/84, 174/75, 83

See application file for complete search history.

(56) References Cited

U.S. PATENT DOCUMENTS 6,059,594 A * 5/2000 Davis et al. ..... 439/275
6,244,886 B1 * 6/2001 Strang et al. ..... 439/271
6,452,099 B1 * 9/2002 Miller et al. ..... 174/65 G
6,830,459 B2 * 12/2004 West ..... 439/63

FOREIGN PATENT DOCUMENTS

DE 196 30 333 A1 2/1997

* cited by examiner

*Primary Examiner*—P. Austin Bradley
*Assistant Examiner*—Phuongchi Nguyen
(74) *Attorney, Agent, or Firm*—Barley Snyder LLC

(57) ABSTRACT

A contact for an electrical connector comprises a substantially cylindrical contact body. The contact body has a first conductor engaging portion at a first conductor receiving end and a second conductor engaging portion at a second conductor receiving end. First and second seal members are mounted on the contact body. The first seal member has a first plurality of axially spaced annular projections extending away from the contact body. The second seal member has a second plurality of axially spaced annular projections extending away from the contact body. The first plurality of axially spaced annular projections has outer ends that bend more towards the first conductor receiving end than outer ends of the second plurality of axially spaced annular projections when the contact is inserted into a contact receiving passageway of the electrical connector.

24 Claims, 4 Drawing Sheets

SEAL CARRYING ELECTRICAL CONTACT

FIELD OF THE INVENTION

The invention relates to an electrical contact and, more particularly, to a contact for an electrical connector having at least one seal member that forms a seal between a contact receiving passageway of the electrical connector and the contact such that liquid is prevented from passing through the contact receiving passageway of the electrical connector.

BACKGROUND OF THE INVENTION

One field of use of such a contact and electrical connector is to electrically connect electrical conductors on an outer side of a cylinder head wall of a combustion engine with electrical conductors on an inner side of the cylinder head wall of the combustion engine. Examples of such a use include terminating electrical components on the inner side of the cylinder head wall for engine brake management or terminating electromagnetic fuel valves for fuel injection management. In this environment, the contacts and the electrical connectors are exposed to vibrations, high temperatures, and external forces, particularly on the outer side of the cylinder head wall. Additionally, adequate sealing is needed to prevent pressurised engine oil on the inner side of the cylinder head wall from passing through to the outer side of the cylinder head wall and for preventing water on the outer side of the cylinder head wall from passing through to the inner side of the cylinder head wall.

An example of such a conventional electrical connector is disclosed in DE-A-196 30 333. The electrical connector has a housing with a plurality of contact receiving passageways that receive contacts. Each of the contacts has a body portion including a conductor engaging end for forming an electrical connection with a corresponding conductor and a terminal end for engaging a mating contact of a mating connector. First and second recesses are formed along each of the body portions for receiving first and second seal members. The first and second seal members are, for example, O-rings, and form a seal between the contact and the contact receiving passageway for preventing liquid from passing through the contact receiving passageway.

To use the conventional electrical connector as a lead-through through a cylinder head wall of a combustion engine, the housing of the electrical connector is mounted in a passageway of the cylinder head wall such that the mating connector is on the inner side of the cylinder head wall. In view of the limited space available at the cylinder head wall, the number of contacts that the electrical connector can accommodate is correspondingly limited. For example, if the housing is mounted in a passageway having a diameter of 30 millimeters (mm), then the electrical connector can only accommodate eight contacts. As the number of parameters handled by the motor management of combustion engines and the number of electrical sensors and/or actuators located on the inner side of the cylinder head wall increases, however, it is desirable to also increase the number of contacts that can be accommodated in the housing fitting in the 30 mm passageway.

Additionally, the location of the plug connection of the two mating connectors is at the cylinder head wall. Because the cylinder head wall is exposed to particularly strong vibrations, the plug connections are affected by the vibrations, particularly, the contacts having smaller dimensions. Moreover, vibrations and forces exerted on the conductors may cause the contacts to tilt as a result of the resilience of the first and second seal members. If the contacts tilt, the first and second seal members may become deformed. If the first and second seal members become deformed, the seal between the contact and the contact receiving passageway may deteriorate. Because the risk of such deterioration increases with a decrease in the dimensions of the first and second seal members, the ability to reduce the dimensions of the contacts is further limited.

It is therefore desirable to provide an electrical connector that can house more than eight contacts in a passageway having a diameter of 30 mm without adversely affecting the performance of the electrical connector.

SUMMARY OF THE INVENTION

The invention relates to an electrical connector comprising an insulative housing having a plurality of contact receiving passageways extending from a first axial face to a second axial face of the housing. A contact is arranged in the contact receiving passageway. The contact has a substantially cylindrical contact body and a first conductor engaging portion arranged at the first axial face and a second conductor engaging portion arranged at the second axial face. A first seal member is mounted on the contact body. The first seal member has a first plurality of axially spaced annular projections extending away from the contact body that engage an inner surface of the contact receiving passageway. The first plurality of axially spaced annular projections is capable of being bent towards the first axial face.

The invention further relates to a contact comprising a substantially cylindrical contact body having a first conductor engaging portion at a first conductor receiving end and a second conductor engaging portion at a second conductor receiving end. A first seal member is mounted on the contact body. The first seal member has a first plurality of axially spaced annular projections extending away from the contact body. The first plurality of axially spaced annular projections has outer ends bendable towards the first conductor receiving end when the contact is inserted into a contact receiving passageway of the electrical connector.

DETAILED DESCRIPTION OF THE INVENTION

Figure 1:
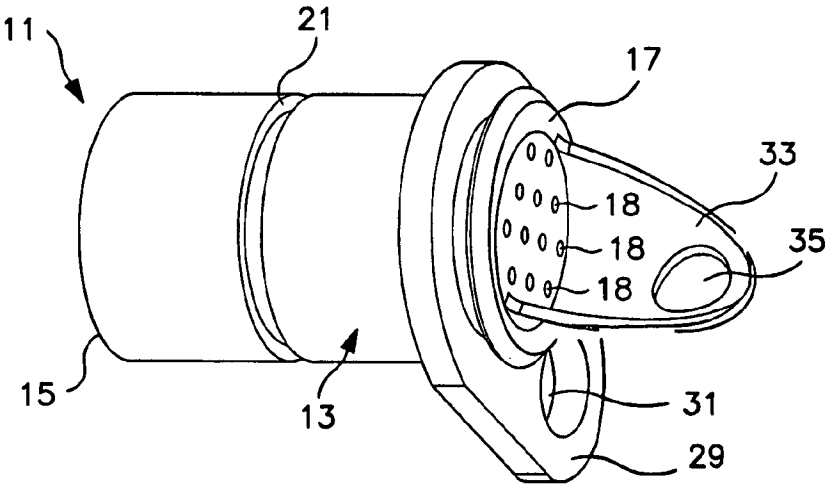
FIG. 1 is an isometric view of an electrical connector according to the invention.
Figure 3:
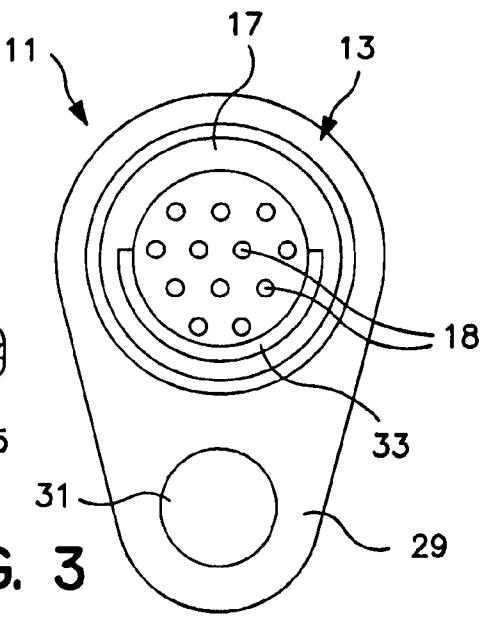
FIG. 3 is a top schematic view of the electrical connector of FIG. 1 taken from a right-hand side of FIG. 1.

FIG. 1 shows an electrical connector 11. The electrical connector 11 will be described in greater detail hereafter and will be described by way of example as an electrical lead-through through a cylinder head wall 26 of a combustion engine of a truck.

Figure 5:
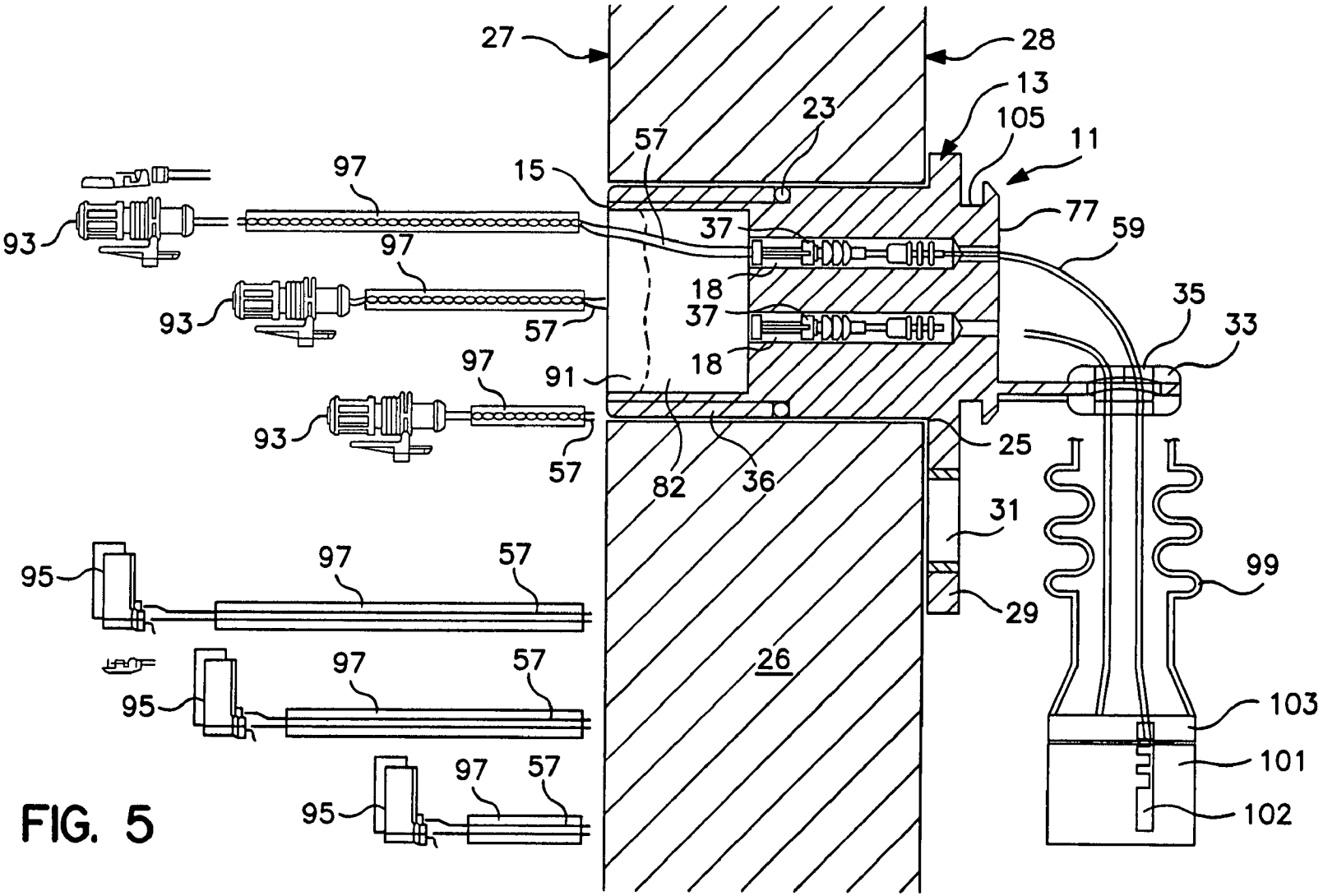
FIG. 5 is a schematic view in partial cross-section of an arrangement with the electrical connector of FIG. 1 showing first and second conductors connected to the contacts of the electrical connector wherein the first and second conductors have terminals at ends remote from the electrical connector.

As shown in FIG. 1, the electrical connector 11 includes an insulating housing 13 having a first axial face 15 and a second axial face 17. The housing 13 may be formed, for example, from nylon (PA66) or a reinforced polybutylene terephthalate (PBT). Between the first and second axial faces 15, 17 of the housing 13 is a seal receiving recess 21, which is formed to receive an outer seal member 23, such as an O-ring, shown in FIG. 2. As shown in FIG. 5, the outer seal member 23, for example, seals a housing receiving passageway 25 of a cylinder head wall 26 that has an inner surface 27 and an outer surface 28.

Figure 2:
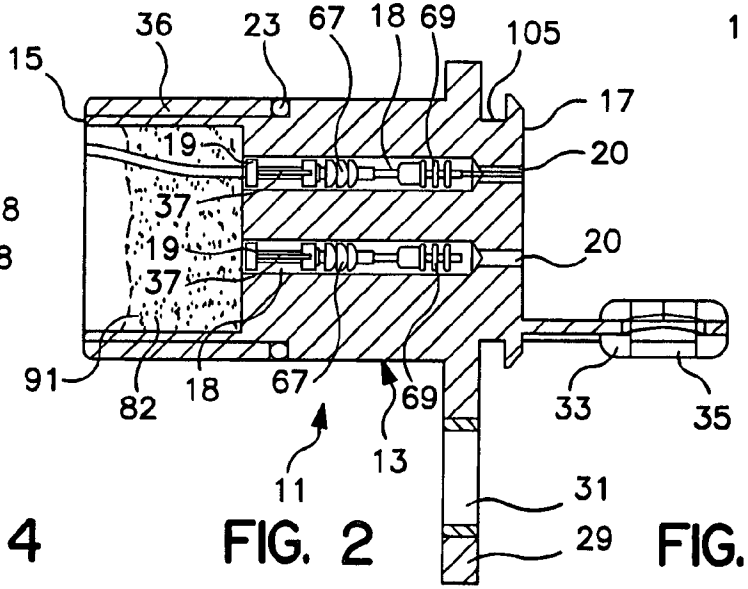
FIG. 2 is a cross-sectional view of the electrical connector of FIG. 1 showing contacts arranged therein.
Figure 4:
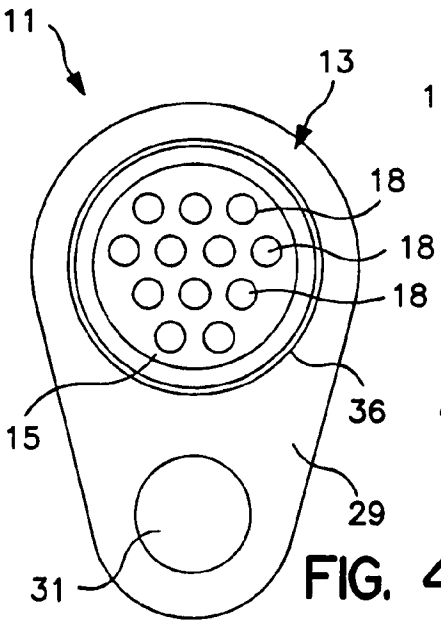
FIG. 4 is a bottom schematic view of the electrical connector of FIG. 1 taken from the left-hand side of FIG. 1.

As best shown in FIG. 2, the first axial face 15 comprises an axially extending shroud 36. The shroud 36 forms a cylindrical cavity 91 at the first axial face 15 of the housing 13. As shown in FIG. 1, the second axial face 17 has a flange 29. The flange 29 radially extends from one peripheral side of the housing 13 and has a flange opening 31 for mounting the flange 29 to the cylinder head wall 26 with, for example, a screw. A grommet 33 having a shape of a half shell axially extends from the second axial face 17 of the housing 13 adjacent to the flange 29. The grommet 33 has a grommet opening 35. The second axial face 17 is further provided with an annular recess 105.

Figure 6:
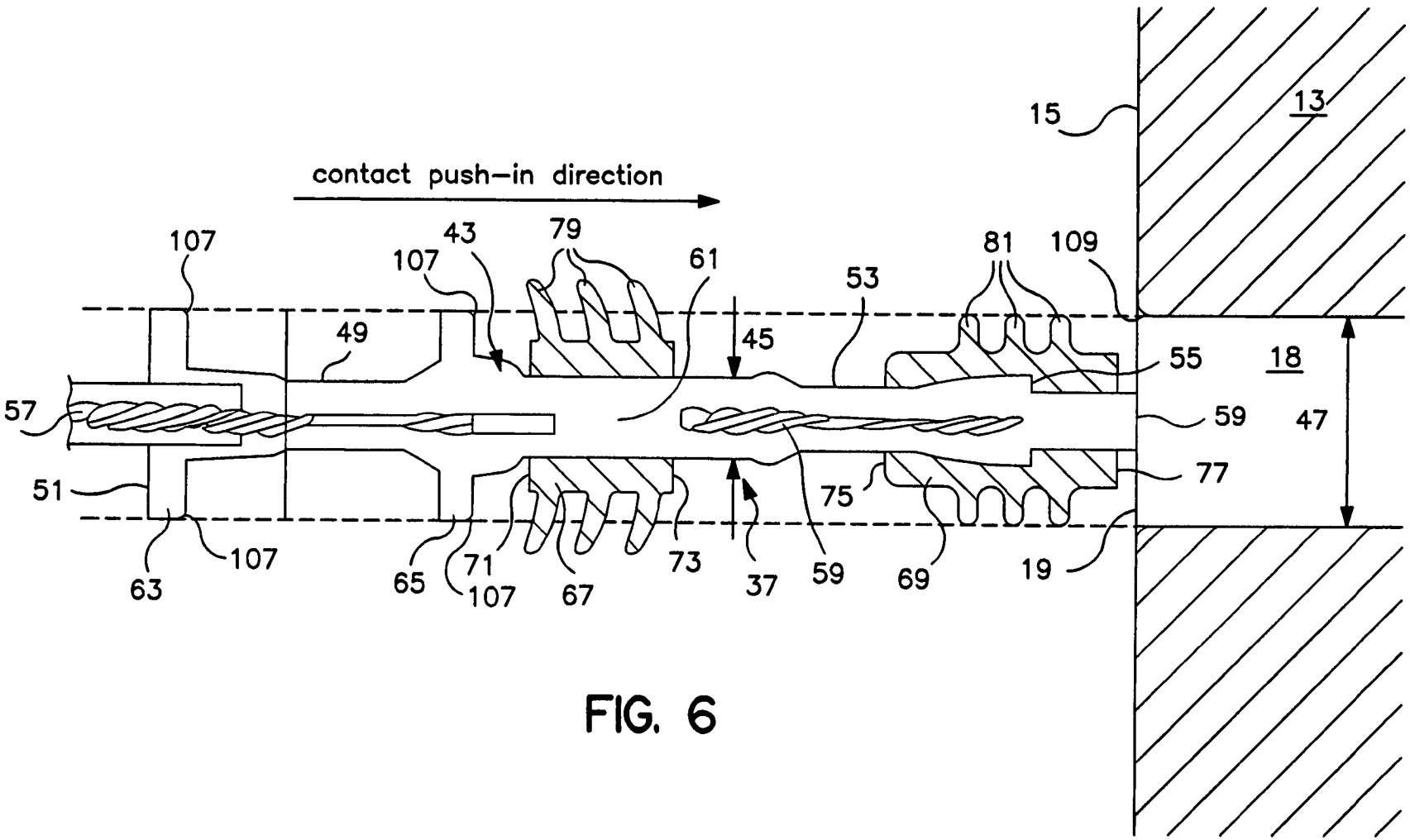
FIG. 6 is a partial cross-sectional view of one of the contacts of FIG. 5 shown connected to the first and second conductors before being received in a contact receiving passageway of the electrical connector of FIG. 1.

As shown in FIG. 2, a plurality of contact receiving passageways 18 axially extends through the housing 13. Each of the contact receiving passageways 18 has a first axial end 19 and a second axial end 20. The first axial end 19 may be formed to have bevels 109 that taper inward toward the contact receiving passageway 18, as best shown in FIG. 6.

A contact 37 is received in each of the contact receiving passageways 18 of the housing 13. As best shown in FIG. 6, each of the contacts 37 has a substantially cylindrical contact body 43. The contact body 43 may be formed from an alloy, such as phosphorous-bronze (CuSn) or brass (CuZn). The contact body 43 has a main part with an outer diameter 45 smaller than an inner diameter 47 of the respective contact receiving passageway 18. The contact body 43 has a tubular first conductor engaging portion 49 at a first conductor receiving end 51 and a tubular second conductor engaging portion 53 at a second conductor receiving end 55. The first conductor engaging portion 49 is in crimp connection with a first stranded conductor 57 that is received in the first conductor engaging portion 49. The first stranded conductor 57 extends from the first conductor receiving end 51 of the contact body 43. The second conductor engaging portion 53 is in crimp connection with a second stranded conductor 59 received in the second conductor engaging portion 53. The second stranded conductor 59 extends from the second conductor receiving end 55 of the contact body 43.

The contact body 43 has a solid middle portion 61 extending between the tubular first and second conductor engaging portions 49, 53. The solid middle portion 61 prevents engine oil, for example, from reaching the second conductor engaging portion 53 by preventing the engine oil from creeping along strands of the first conductor 57 and/or between the strands and an outer insulating coating of the first conductor 57 and/or along the outside of the outer insulating coating. Similarly, water creeping along the strands of the second conductor 59 and/or between the strands and an outer insulating coating of the second conductor 59 and/or along the outside of the outer insulating coating is prevented from reaching the first conductor engaging portion 49.

The contact body 43 has first and second radial collars 63, 65. The first radial collar 63 is located at the first conductor receiving end 51 of the contact body 43 and the second radial collar 65 is located at the inner end of the first conductor engaging portion 49. Each of the first and second radial collars 63, 65 may be formed to have entrance bevels 109. The outer surfaces of the first and second radial collars 63, 65 may be formed to have radial teeth (not shown) that indent into the material of the inner wall of the contact receiving passageway 18. Alternatively, the outer surfaces of the first and second radial collars 63, 65 may be made smooth and adjusted to the inner diameter of the contact receiving passageway 18 either without clearance or with a small clearance of a few millimeters, for example 1/10 mm, so that the first and second radial collars 63, 65 may be press-fit in the contact receiving passageway 18. The first and second radial collars 63, 65 fix the contact 37 within the contact receiving passageway 18, for example, by press-fitting, and prevent the contact body 43 from tilting within the passageway 18.

First and second seal members 67, 69 are mounted on the contact body 43 at an axial distance from each other by, for example, press-fit mounting, molding, or vulcanizing first and second seal members 67, 69 onto the contact body 43. The first and second seal members 67, 69 are made of a heat-resistant, stress-resistant, and contaminant-resistant resilient material that retains permanent elasticity even in harsh environments. For example, suitable materials for the first and second single seal members 67, 69 may be a silicone elastomer (VMQ) or a fluor-silicone elastomer (FVMQ).

The first seal member 67 is mounted on the contact body 43 adjacent to the solid middle portion 61. The first seal member 67 has a first axial side 71 facing the first conductor receiving end 51 of the contact body 43 and a second axial side 73 facing the second conductor receiving end 55 of the contact body 43. The first seal member 67 includes a first plurality of axially spaced annular projections 79. The first plurality of projections 79 axially extend such that when the contact 37 is pushed into the contact receiving passageway 18 from the first axial end 19 thereof, outer ends of the first plurality of projections 79 are bent towards the first conductor receiving end 51 of the contact body 43.

The second seal member 69 is mounted on the contact body 43 adjacent to the second conductor receiving end 55 and has a portion that axially extends beyond the second conductor receiving end 55 of the contact body 43. The second seal member 69 has a first axial side 75 facing the first conductor receiving end 51 of the contact body 43 and a second axial side 77 facing the second conductor receiving end 55 of the contact body 43. The second seal member 69 has a second plurality of axially spaced annular projections 81. The second plurality of projections 81 axially extend such that when the contact 37 is pushed into the contact receiving passageway 18 from the first axial end 19 thereof, outer ends of the second plurality of projections 81 substantially contact the inner wall of the contact receiving passageway 18 but either remain straight or are bent less than the first plurality of projections 79.

Although the first and second seal members 67, 69 are illustrated as each having three of each of the first and second annular projections 79, 81, the number of projections is not limited to three and may vary depending on the desired sealing effect for a particular application.

Figure 7:
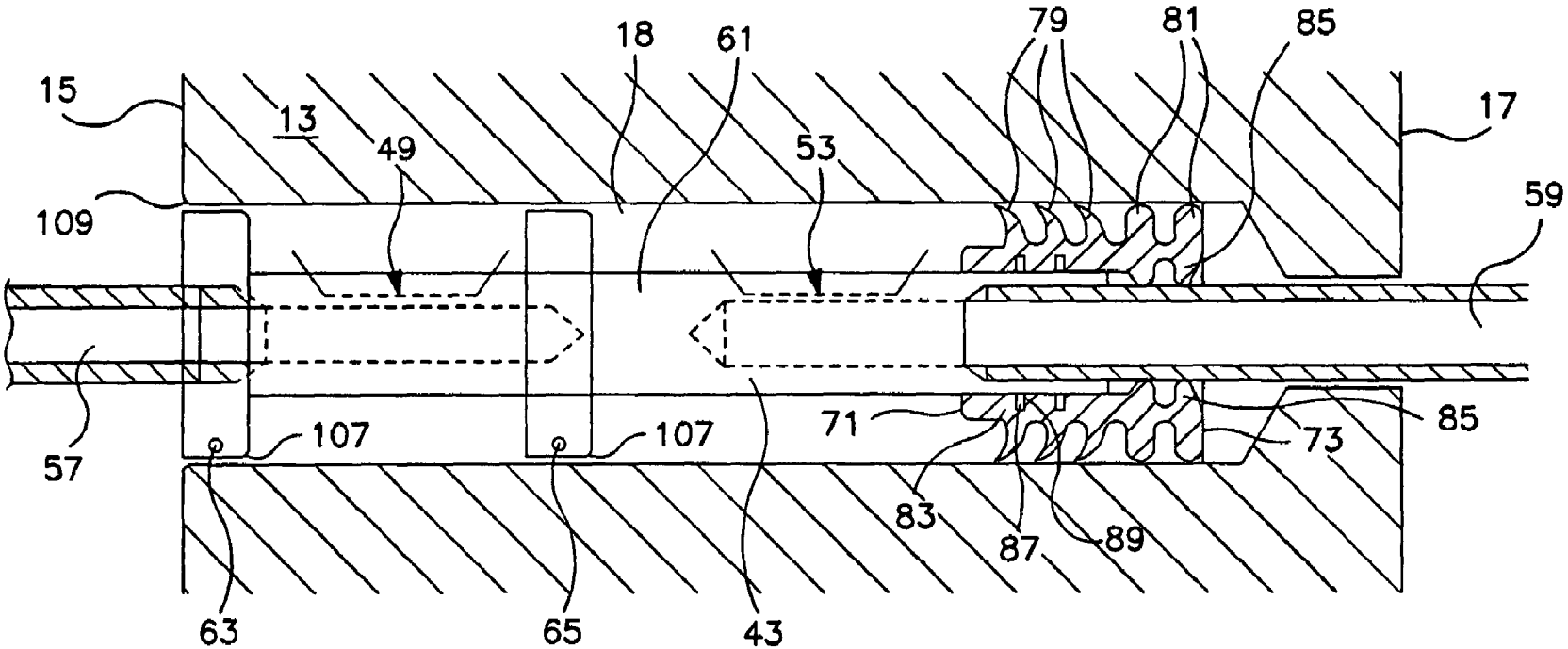
FIG. 7 is a partial cross-sectional view of an alternate embodiment of the contact of FIG. 6 shown received in the contact receiving passageway of the electrical connector of FIG. 1.

FIG. 7 shows an alternate embodiment of the contact 37. In the alternate embodiment, the contact 37 has a single seal member 83 made of the same material as the first and second seal members 67, 69. The single seal member 81 has the first and second pluralities of annular projections 79, 81. The first plurality of projections 79 is arranged to face the first conductor receiving end 51, and the second plurality of projections 81 is arranged to face the second conductor receiving end 55. The axial part of the single sealing member 83 having the second plurality of projections 81 extends beyond the second conductor receiving end 55 of the contact body 43. When the contact 37 is pushed into the contact receiving passageway 18 from the first axial end 19 thereof, the outer ends of the first plurality of projections 79 are bent towards the first conductor receiving end 51 of the contact body 43 and the outer ends of the second plurality of projections 81 substantially contact the inner wall of the contact receiving passageway 18 without being bent or by being bent less than the first plurality of projections 79. By bending the outer ends of the first plurality of projections 79 towards the first axial end 19 of the passageway 18, the seal between the passageway 18 and the first plurality of projections is increased when engine oil pressing against the first plurality of projections 79 urges the bent outer ends of the first plurality of projections 79 against the inner wall of the passageway 18.

The axial region of the second plurality of projections 81 of the single seal member 83 is provided with a plurality of small projections 85 extending inwardly from an inner diameter of the single sealing member 83. The small projections 85 contact an outer periphery of the second conductor 59 to prevent, for example, water from passing from the second axial side 17 between the second conductor 59 and the inner periphery of the single sealing member 83. Water, therefore, is blocked from passing by either the inner periphery or the outer periphery of the sealing member 83.

Although the single seal member 83 is illustrated as having three first annular projections 79 and two second and small annular projections 81, 85 the number of projections is not limited to these amounts and may vary depending on the desired sealing effect for a particular application.

The contact body 43 has a plurality of radially extending annular metal ribs 87 in a region where the single seal member 83 is seated. The inner periphery of the single seal member 83 has a plurality of complementarily formed radially extending annular recesses 89 for receiving the ribs 87. The ribs 87 and the recesses 89 thereby secure the single seal member 83 to the contact body 43. The single seal member 83 may be placed on the contact body 43 by pressing it over the contact body 43 with a tool or by molding or vulcanizing the single seal member 81 onto the contact body 43.

Although the single seal member 83 is only shown having the small projections 85, the inner periphery of the second sealing member 69 of the embodiment of FIG. 6 may also be formed with small projections 85 depending on the desired application. Additionally, the first seal member 67 and/or the second seal member 69 and the contact body 43 of the embodiment of FIG. 6 may be formed with the ribs 87 and recesses 89, respectively, depending on the desired application.

An arrangement showing the electrical connector 11 positioned in the cylinder head wall 26 of an engine will now be explained in greater detail with reference to FIG. 5. As shown in FIG. 5, a first plurality of the first conductors 57 extending from the first axial face 15 of the housing 13 are each arranged as twisted-pairs. Each of the twisted-pairs is terminated by a 2-position connector 93. A second plurality of the first conductors 57 is arranged as straight pairs. Each of the two conductors of each of the straight pairs is terminated by a 1-position connector 95. In one application of the invention, the 2-position connectors 93 make a plug connection to electromagnetic fuel injection valves (not shown), and the 1-position connectors 95 make a releasable connection to engine brake management components (not shown). The first conductors 57 are arranged as flying leads and are heat-protected by means of heat-resistant tubing 97, which secures the cables and protects the cable insulation against wear.

The second conductors 59 extending from the second axial face 17 of the housing 13 are bent by 90 degrees and are bundled by the grommet opening 35. The grommet 33 thereby prevents the cable having the second conductors 59 from axially twisting and further prevents insulation rubbing. The second conductors 59 extend through a bellow 99 to a 12-position connector 101. The free end of the bellow 99 is adapted to be mounted on a collar 103, which is pre-mounted on the connector 101. The connector 101 has, for example, twelve contacts 102, by means of which the second conductors 59 may be connected to a motor management system (not shown). A tube (not shown) extends between the second axial face 17 of the housing 13 and the grommet 33. The tube (not shown) has a 90 degree bend and accommodates parts of the second conductors 59 extending between the second axial face 17 of the housing 13 and the grommet 33. The tube (not shown) is snapped into and secured by the annular recess 105 of the housing 13.

To mount the arrangement of FIG. 5, the first conductor 57 is inserted into the tubular first conductor engaging portions 49 and is crimped therein. The contacts of the connectors 93, 95 are crimped on the free ends of the first conductors 57. The first seal member 67 is mounted on the contact body 43. The second conductor 59 is inserted into the tubular second conductor engaging portions 53 and crimped therein. The second seal member 39 is mounted on the contact body 43. The second conductor 59 with the second seal member 69 mounted thereon and the contact 37 connected to the second conductors 59 is then slid into the respective contact receiving passageway 18 of the housing 13 (twisted pair by twisted pair in the case of the embodiment shown in FIG. 5 where each of the connectors 93, 95 terminates two of the first conductors 57). The bevels 109 formed on the housing 13 and the entrance bevels 107 formed on each of the collars 63, 65 facilitate entry of the contact 37 into the respective contact receiving passageway 18. The second conductor 59 is then fed through the grommet opening 35 and the contacts 102 are crimped to the free end of the second conductor 59. The contacts 102 are led through the bellows 99 and are inserted into the housing of the connector 101 with the pre-mounted collar 103. The resulting harness is now mounted on the cylinder head wall 26 by inserting the housing 13 of the harness into the housing receiving passageway 25 of the cylinder head wall 26. Because the first and second conductors 57, 59 are directly connected to the contact 37, there is no plug connection in the region of the cylinder head wall 26. Thus, a stable connection is provided that has a high resistance to vibrations and mechanical forces applied to the first and second conductors 57, 59.

When using the contact 37 as a lead-through through the cylinder head wall 26, the contact receiving passageways 18 could also be formed in the cylinder head wall 26 itself. This arrangement is possible if the cylinder head wall 26 is made of an electrically insulating material, such as, ceramic or plastic, or if the cylinder head wall 26 is made of an electrically conducting material, such as, steel, and the inner wall of each of the contact receiving passageways 18 is coated with an electrically insulating material. This arrangement allows a rather large number of contacts 37 to be arranged in a limited space. This arrangement, however, can not be used when both ends of the harness comprising the contact 37 already have connectors 93, 95 attached thereto that can not be passed through the contact receiving passageway 18 formed in the cylinder head wall 26.

In an embodiment wherein the contacts 37 are pushed into contact receiving passageways directly formed in the cylinder head wall 26 as well in the embodiment wherein the contacts 37 are received in passageways 18 of the housing 13, the cylinder head wall 26 is removed from the cylinder head while the contacts 37 crimped to the respective first conductors 57 are pushed into the respective contact receiving passageway of either the cylinder head wall 26 or the housing 13, which is already fixed in the housing receiving passageway 25 of the cylinder head wall 26.

The first axial ends 51 of the contact body 43 may additionally be fixed by potting 82 instead of or in addition to press-fitting the collars 63, 65 into the contact receiving holes 18. Fixing the contact 37 with the potting 82 is advantageous in that the contact 37 and the cable comprising the first conductors 57 are fixed and movements thereof are damped. The potting 82 additionally protects against high temperature and blocks oil from entering into the cable and flowing back to the connectors 93, 95.

I claim:

1. An electrical connector, comprising:

an insulative housing having a plurality of contact receiving passageways extending from a first axial face to a second axial face of the housing, a contact arranged in each of the contact receiving passageways, the contact having a substantially cylindrical contact body and a first conductor engaging portion arranged at the first axial face and a second conductor engaging portion arranged at the second axial face;

a first seal member mounted on the contact body, the first seal member having a first plurality of axially spaced annular projections extending away from the contact body that engage an inner surface of the contact receiving passageway, the first plurality of axially spaced annular projections being bent towards the first axial face; and the contact body has at least one radial collar for preventing the contact from tilting in the contact receiving passageway.

2. The electrical connector of claim 1, wherein the contact body has ribs that engage the first seal member to secure the first seal member to the contact body.

3. The electrical connector of claim 1, wherein the first and second conductor engaging portions are crimping portions for crimping the first and second conductor engaging portions to first and second conductors, respectively.

4. The electrical connector of claim 1, wherein the at least one radial collar has an entrance bevel for facilitating entry of the contact into the contact receiving passageway.

5. The electrical connector of claim 1, wherein the second axial face of the housing includes a grommet and a flange.

6. The electrical connector of claim 1, wherein the housing includes an outer seal member attached to an outer periphery of the housing.

7. The electrical connector of claim 1, wherein the contact body includes a solid middle portion positioned between the first and second conductor engaging portions.

8. The electrical connector of claim 1, further comprising a second seal member mounted on the contact body, the second seal member having a second plurality of axially spaced annular projections extending away from the contact body that engage the inner surface of the contact receiving passageway, the second plurality of axially spaced annular projections being bent towards the first axial face less than the first plurality of axially spaced annular projections.

9. The electrical connector of claim 8, wherein the second seal member is positioned proximate the second conductor engaging portion and extends beyond a second conductor receiving end of the contact body.

10. The electrical connector of claim 1, wherein the first axial face of the housing includes a shroud that forms a cavity adjacent to the contact receiving passageway.

11. The electrical connector of claim 10, further comprising potting positioned in the cavity formed by the shroud for fixing the contact in the contact receiving passageway.

12. The electrical connector of claim 1, wherein the first seal member includes a second plurality of axially spaced annular projections extending away from the contact body that engage the inner surface of the contact receiving passageway, the second plurality of axially spaced annular projections being bent towards the first axial face less than the first plurality of axially spaced annular projections.

13. The electrical connector of claim 12, wherein the first seal member is positioned proximate the second conductor engaging portion and has a portion that extends beyond a second conductor receiving end of the contact body.

14. The electrical connector of claim 13, wherein the portion of the first seal member that extends beyond the second conductor receiving end of the contact body has small projections for engaging with a conductor.

15. A contact for an electrical connector, comprising:

a substantially cylindrical contact body having a first conductor engaging portion at a first conductor receiving end and a second conductor engaging portion at a second conductor receiving end;

a first seal member mounted on the contact body, the first seal member having a first plurality of axially spaced annular projections extending away from the contact body, the first plurality of axially spaced annular projections having outer ends bendable towards the first conductor receiving end when the contact is inserted into a contact receiving passageway of the electrical connector; and the contact body has at least one radial collar.

16. The contact of claim 15, wherein the first seal member includes a second plurality of axially spaced annular projections extending away from the contact body, the second plurality of axially spaced annular projections having outer ends positioned closer to the contact body then the outer ends of the first plurality of axially spaced annular projections.

17. The contact of claim 15, wherein the contact body has ribs that engage the first seal member to secure the first seal member to the contact body.

18. The contact of claim 15, wherein the first and second conductor engaging portions are crimping portions for crimping the first and second conductor engaging portions to first and second conductors, respectively.

19. The contact of claim 15, wherein the at least one radial collar has an entrance bevel.

20. The contact of claim 15, wherein the contact body includes a solid middle portion positioned between the first and second conductor engaging portions.

21. The contact of claim 15, further comprising a second seal member mounted on the contact body, the second seal member having a second plurality of axially spaced annular projections extending away from the contact body, the second plurality of axially spaced annular projections having outer ends positioned closer to the contact body then the outer ends of the first plurality of axially spaced annular projections.

22. The contact of claim 21, wherein the second seal member is positioned proximate the second conductor engaging portion and extends beyond the second conductor receiving end of the contact body.

23. The contact of claim 15, wherein the first seal member is positioned proximate the second conductor engaging portion and has a portion that extends beyond the second conductor receiving end of the contact body.

24. The contact of claim 23, wherein the portion of the first seal member that extends beyond the second conductor receiving end of the contact body has small projections for engaging with a conductor.

* * * * *